United States Patent [19]

Chester et al.

[11] Patent Number: 4,469,909

[45] Date of Patent: Sep. 4, 1984

[54] HEAVY AROMATICS PROCESS

[75] Inventors: Arthur W. Chester; Yung-Feng Chu, both of Cherry Hill, N.J.

[73] Assignee: Mobil Oil Corporation, New York, N.Y.

[21] Appl. No.: 528,683

[22] Filed: Sep. 1, 1983

Related U.S. Application Data

[63] Continuation of Ser. No. 389,747, Jun. 18, 1982, abandoned.

[51] Int. Cl.[3] ..... C07C 5/24; C07C 5/30

[52] U.S. Cl. ..... 585/481; 502/77; 585/482; 585/483; 585/488; 585/489

[58] Field of Search ..... 585/481, 482, 483, 488, 585/489, 479

[56] References Cited

U.S. PATENT DOCUMENTS

| | | | |
|---|---|---|---|
| 4,163,028 | 7/1979 | Tabak et al. | 585/481 |
| 4,224,141 | 9/1980 | Morrison et al. | 585/481 |
| 4,312,790 | 1/1982 | Butter et al. | 585/481 |
| 4,341,622 | 7/1982 | Tabak et al. | 585/489 |
| 4,351,979 | 9/1982 | Chester et al. | 585/481 |
| 4,385,195 | 5/1983 | Butter et al. | 585/481 |

*Primary Examiner*—Delbert E. Gantz
*Assistant Examiner*—A. Pal
*Attorney, Agent, or Firm*—Alexander J. McKillop; James F. Powers, Jr.; Dennis P. Santini

[57] ABSTRACT

This invention provides a catalytic process for converting to BTX a $C_9$+ monocyclic aromatic hydrocarbon feed having a prescribed content of alkyl groups with more than one carbon atom. It further provides a process wherein said conversion is coupled with a catalytic xylene isomerization unit. The catalyst used in the process is a steamed composite comprising platinum and a crystalline zeolite such as ZSM-5.

11 Claims, 1 Drawing Figure

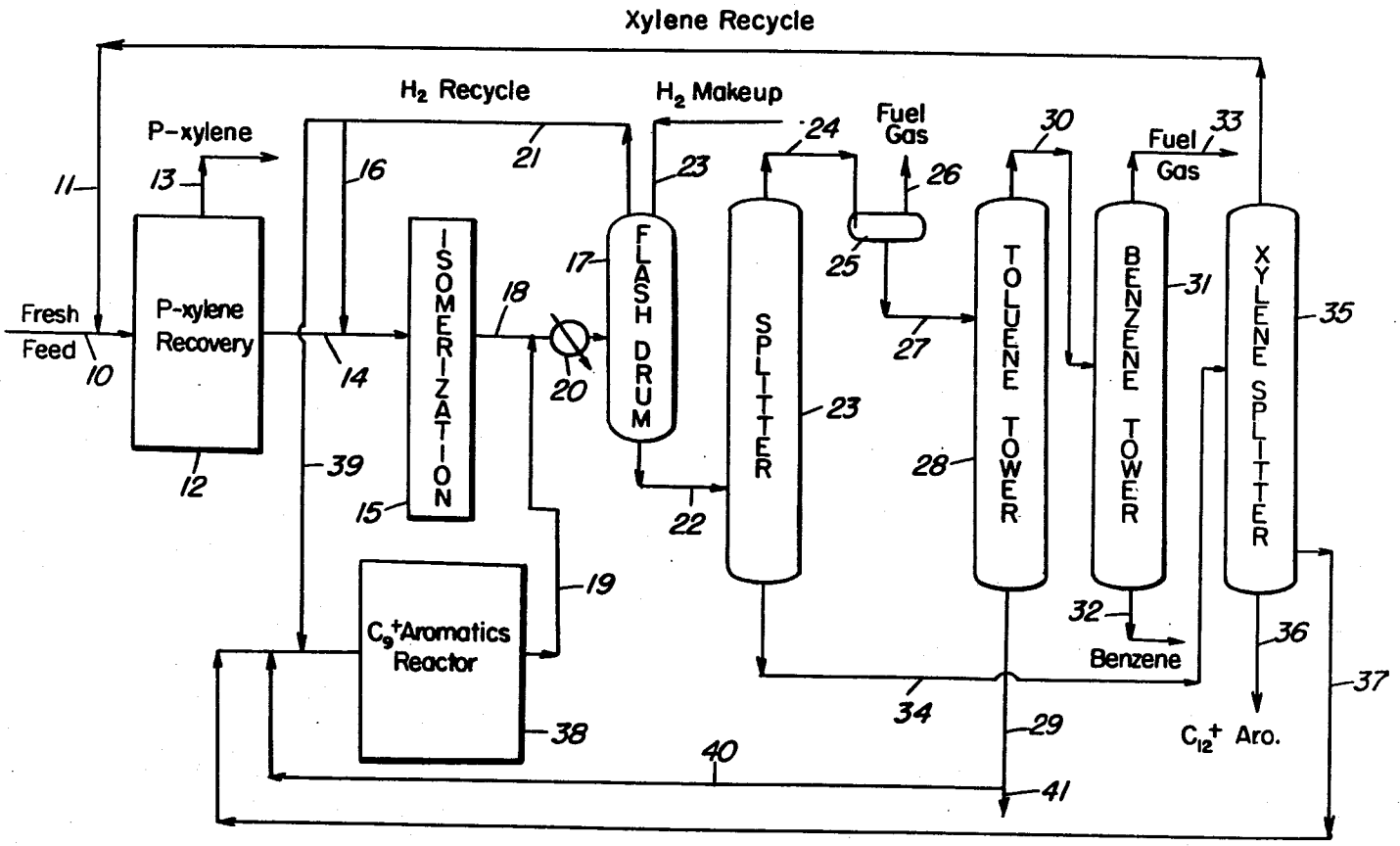
Xylene Recycle
H2 Makeup
H2 Recycle
Fresh Feed
P-xylene
P-xylene Recovery
ISOMERIZATION
FLASH DRUM
SPLITTER
Fuel Gas
Fuel Gas
TOLUENE TOWER
BENZENE TOWER
XYLENE SPLITTER
Benzene
C12+ Aro.
C9+Aromatics Reactor
10
11
12
13
14
15
16
17
18
19
20
21
22
23
24
25
26
27
28
29
30
31
32
33
34
35
36
37
38
39
40
41

HEAVY AROMATICS PROCESS

This application is a continuation of copending application Ser. No. 389,747 filed June 18, 1982, now abandoned.

FIELD OF THE INVENTION

This invention is concerned with processing heavy aromatic feeds. In one aspect, the invention is concerned with producing a hydrocarbon mixture rich in benzene, toluene and xylenes (hereinafter simply BTX) from a $C_9$+ feed of the type produced as a by-product from a xylene isomerization process. In another aspect, the invention is concerned with a highly efficient process for isomerizing xylenes wherein loss of feed to by-products is reduced.

BACKGROUND OF THE INVENTION

Of the aromatic compounds used in industry, benzene, toluene and xylenes are of outstanding importance on a volume basis. A mixture of those compounds, often designated BTX for convenience, is derived primarily from such aromatic naphthas as petroleum reformates and pyrolysis gasolines. The former result from processing petroleum naphthas over a catalyst such as platinum on alumina at temperatures which favor dehydrogenation of naphthenes. Pyrolysis gasolines are liquid products resulting from mild hydrogenation (to convert diolefins to olefins without hydrogenation of aromatic rings) of the naphtha fraction that is obtained in the steam cracking of hydrocarbons to manufacture ethylene, propylene, etc. Crude naphtha cuts are usually treated with a solvent highly selective for aromatics to obtain an aromatic extract consisting of the benzene and alkylated benzenes present in the aromatic naphtha.

The supply of BTX sometimes may be augmented by treating aromatic hydrocarbon mixtures of higher molecular weight than xylene, such as a heavy cut from petroleum reformates, in which a very high proportion of the alkyl carbon atom content is contained in the alkyl substituents on aromatic rings. The alkyl substituents in a typical reformate are, to a major extent, methyl groups, with some ethyl groups present together with a few propyl and butyl groups. Longer alkyl chains are present in such small amount that they can be disregarded. U.S. Pat. No. 3,945,913 issued Mar. 3, 1976 describes a process wherein $C_9$+ reformate is catalytically converted to BTX by contact with type ZSM-5 zeolite, zeolite ZSM-12 or ZSM-21 at a temperature of about 550° to about 1000° F. U.S. Pat. No. 4,078,990 issued Mar. 14, 1978 describes a process for making BTX from heavy reformate that contains not more than 20 weight percent xylenes by catalytic contact with a solid, porous acidic catalyst characterized by a Constraint Index not higher than 1 at a temperature about 500° to about 1000° F. U.S. Pat. No. 3,948,758 issued Apr. 6, 1976 discloses catalytically processing heavy reformate from which benzene and lighter components have been removed to decrease the average weight of the aromatics. U.S. Pat. No. Re. 29,857, reissued Dec. 5, 1978, discloses ZSM-5 zeolites as useful in hydrocracking and other hydrocarbon conversion reactions. All of the foregoing patents are incorporated herein by reference as if fully set forth.

Recovery of the individual aromatic hydrocarbons from BTX is relatively simple for benzene and toluene. The $C_8$ fraction, however, contains four isomers, some of which are not readily separated by distillation. Furthermore, not all of the isomers are as valuable commercially as the p-xylene, and it is desirable to convert some or all of the less desirable isomers to the para form.

Techniques are known for separating p-xylene by fractional crystallization with isomerization of the other two isomers for recycle in a loop to the p-xylene separation. That operation is hampered by the presence of ethyl benzene (EB). However, a widely used xylene isomerization technique, "Octafining" prevents build-up of EB in the separation-isomerization loop.

The manner of producing p-xylene by a loop including Octafining can be understood by consideration of a typical charge from reforming petroleum naphtha. The $C_8$ aromatics in such mixtures and their properties are:

| | Freezing Point F. | Boiling Point F. | Density Lbs./U.S. Gal. |
|---|---|---|---|
| Ethyl benzene | −139.0 | 277.1 | 7.26 |
| P-xylene | 55.9 | 281.0 | 7.21 |
| M-xylene | −54.2 | 282.4 | 7.23 |
| O-xylene | −13.3 | 292.0 | 7.37 |

The $C_8$ aromatic fractions from the above-described sources vary quite widely in composition but will usually be in the range 10 to 32 wt.% ethyl benzene with the balance, xylenes, being divided approximately 50 wt.% meta, and 25 Wt.% each of para and ortho.

Calculated thermodynanic equilibria for the $C_8$ aromatic isomers at Octafining conditions are:

| Temperature | 850° F. |
|---|---|
| Wt. % ethyl benzene | 8.5 |
| Wt. % para xylene | 22.0 |
| Wt. % meta xylene | 48.0 |
| Wt. % ortho xylene | 21.5 |
| | 100.0 |

An increase in temperature of 50° F. will increase the equilibrium concentration of ethyl benzene by about 1 wt.%, ortho xylene is not changed and para and meta xylenes are both decreased by about 0.5 wt.%.

In recent years processes utilizing zeolite catalysts have become available as alternatives to Octafining. A recent development in catalytic vapor phase isomerization is described in U.S. Pat. No. 3,856,872 to Morrison issued Dec. 24, 1974. It is there shown that use of a catalyst such as HZSM-5 in combination with a metal having hydrogenation/dehydrogenation promoting capability under essentially Octafining conditions is very efficient for isomerization of xylenes at reduced hydrogen flow as compared with Octafining. The extent of xylene loss is substantially reduced by this change of catalyst. Concurrently, the mechanism of ethyl benzene conversion is drastically changed on substitution of, e.g. NiHZSM-5, for the platinum on silica/alumina of Octafiners. The Morrison process results in conversion of ethyl benzene by transalkylation reactions including disproportionation of ethyl benzene to benzene and diethyl benzene, disproportionation and ethylation of xylene and the like producing alkyl aromatic compounds of nine or more carbon atoms ($C_9$+) together with benzene and toluene. Those conversion products are readily separated in the loop for recovery of p-xylene and isomerization of o- and m-xylenes. In general, loss of xylenes increases as severity of the isomerizer is increased to enhance the conversion of ethyl benzene. The entire contents of the foregoing patents are herein incorporated by reference as if fully set forth.

Although extensive advances have been made in processes for augmenting the supply of BTX, and in improved processes for isomerizing xylenes, significant process inefficiencies are still encountered because by-products are created in the loop. These include by-products both lighter and heavier than $C_8$. U.S. Pat. No. 4,101,597 discloses an improved process for recovering p-xylene wherein the by-product $C_9$+ fraction is converted to BTX and recycled to the p-xylene recovery unit. U.S. Pat. No. 4,100,214 issued July 11, 1978 discloses a vapor phase process for xylene isomerization wherein a limited amount of $C_9$+ recycle together with toluene is added as diluent to the frest xylenes feed.

SUMMARY OF THE INVENTION

The present invention is based on the discovery that a mixture of monocyclic alkylaromatic hydrocarbons boiling in the $C_9$+ to 500° F. range and in which a substantial fraction of the alkyl groups have more than one carbon atom, may be converted with little or essentially no loss of aromatic rings to (1) a liquid product rich in benzene, toluene and xylenes, and (2) a lesser amount of gaseous product comprising a large fraction of ethane and higher alkanes. This is effected, as more fully described hereinbelow, by contacting the mixture in the presence of hydrogen with a catalyst comprising a platinum group metal, preferably platinum, and a crystalling zeolite having a silica to alumina ratio of at least 12 and a Constraint Index of 1 to 12, preferably ZSM-5 or ZSM-11, which catalyst is steamed, as further described below, prior to contact with the feed to be converted. The conditions for effecting this conversion include a temperature of 600° to 900° F., the preferred range being 650° to 800° F., a pressure of about 50 to 750 psig, a WHSV of about 0.5 to 30, and a hydrogen to hydrocarbon mol ration of about 0.5 to 10.

This invention is particularly effective with $C_9$+ feeds having the composition indicated above, and is to be differentiated from processes which are effective for converting the usual $C_9$+ heavy reformate. Heavy reformate, in general, is composed largely of polymethylated benzenes, and requires a catalyst and reaction conditions effective for demethylation in order to form a mixture rich in benzene, toluene and xylenes (hereinafter referred to as BTX for convenience).

The catalyst used in the process of the present invention is prepared by the method described in U.S. Pat. No. 4,312,790. In particular, the catalyst comprises a crystalline zeolite having a Constraint Index of 1 to 12, a silica to alumina ratio of at least 12, and a platinum group metal incorporated in cationic form with said zeolite prior to final catalyst particle formation and prior to any calcination or steaming of said zeolite.

The extent of steaming of the catalyst is that amount required to reduce its alpha value by at least 25 percent, into the range of about 20 and 150.

In one aspect of the present invention, a process is provided for converting to BTX any $C_9$+ of 0.5 to about 3.0 alkyl groups having more than one carbon atom per benzene ring along with some methyl substituents, such structures being exemplified by ethyltoluene, ethylxylene and diethylbenzene.

In general, catalytic xylene isomerization concomitantly generates the type $C_9$+ feed described above as a by-product, because all of the known isomerization catalysts are capable of transalkylating catalytic capabilities. The Morrison process noted above tends to conserve ethyl groups, and for that reason produces a by-product richer in $C_2$ alkyl groups, than Octafining, for example. Thus, in another aspect of the present invention, a process is provided for converting to BTX the $C_9$+ by-product formed concomitantly with xylene isomerization.

In a third aspect of the present invention, an improved process for manufacturing para xylene is provided.

BRIEF DESCRIPTION OF THE DRAWING

The annexed FIGURE illustrates the improved process of xylene isomerization.

DETAILED DESCRIPTION OF THE INVENTION

The catalyst useful for converting the $C_9$+ feed according to the present invention comprises a platinum group metal and a particular crystalline aluminosilicate zeolite more fully described hereinbelow. By platinum group metal we mean any of the metals selected from the group consisting of platinum, iridium, osmium, palladium, rhodium and ruthenium, with platinum being particularly preferred. The amount of platinum group metal present is 0.001 to 1.0% by weight of the crystalline zeolite. It may be present as the metal or as a compound of the metal.

The crystalline zeolites useful herein are members of a novel class of zeolites that exhibit unusual properties. Although these zeolites have unusually low alumina contents, i.e. high silica to alumina ratios, they are very active even when the silica to alumina ratio exceeds 30. The activity is surprising since catalytic activity is generally attributed to framework aluminum atoms and/or cations associated with these aluminum atoms. These zeolites retain their crystallinity for long periods in spite of the presence of steam at high temperature which induces irreversible collapse of the framework of other zeolites, e.g. of the X and A type. Furthermore, carbonaceous deposits, when formed, may be removed by burning at higher than usual temperatures to restore activity. These zeolites, used as catalysts, generally have low coke-forming activity and therefore are conducive to long times on stream between regenerations by burning with oxygen-containing gas such as air.

An important characteristic of the crystal structure of this class of zeolites is that it provides constrained access to and egress from the intracrystalline free space by virtue of having an effective pore size intermediate between the small pore Linde A and the large pore Linde X, i.e. the pore windows of the structure have about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type zeolites useful in this invention posses, in combination: a silica to alumina mol ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina ratio of at least 12 are useful, it is preferred to use zeolites having higher ratios of at least about 30. Such zeolites, after activation, acquire an intracrystalline sorption capacity for normal hexane which is greater than that for water, i.e. they exhibit "hydrophobic" properties. It is believed that this hydrophobic character is advantageous in the present invention.

The zeolites useful in this invention have an effective pore size such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is excluded and the zeolite is not of the desired type. Windows of 10-membered rings are preferred, although in some instances excessive puckering of the rings or pore blockage may render these zeolites ineffective. 12-membered rings usually do not offer sufficient constraint to produce the advantageous conversions, although the puckered 12-ring structure of TMA offretite shows constrained access. Other 12-ring structures may exist which, due to pore blockage or to other cause, may be operative.

Rather than attempt to judge from crystal structure whether or not a zeolite possesses the necessary constrained access to molecules larger than normal paraffins, a simple determination of the "Constraint Index" as herein defined may be made by passing continuously a mixture of an equal weight of normal hexane and 3-methylpentane over a small sample, approximately one gram or less, of zeolite at atmospheric pressure and determining the fraction remaining unchanged for each of the two hydrocarbons, from which the Constraint Index is calculated as follows:

$$\text{Constraint Index} = \frac{\log_{10}(\text{fraction of n-hexane remaining})}{\log_{10}(\text{fraction of 3-methylpentane remaining})}$$

A detailed description of the procedure for determiming the Constraint Index appears in an article titled "Catalysis by Crystalline Aluminosilicates: Characterization of Intermediate Pore-Size Zeolites by the Constraint Index" which appears in Journal of Catalysis, vol. 67, page 218 (1981), the entire content of which is incorporated herein by reference as if fully set forth.

The class of zeolites defined herein is exemplified by ZSM-5, ZSM-11, ZSM-12, ZSM-23, ZSM-35, ZSM-38, and other similar materials.

U.S. Pat. No. 3,702,886 describing and claiming ZSM-5 is incorporated herein by reference.

ZSM-11 is more particularly described in U.S. Pat. No. 3,709,979, the entire content of which is incorporated herein by reference.

ZSM-12 is more particularly described in U.S. Pat. No. 3,832,449, the entire content of which is incorporated herein by reference.

ZSM-23 is more particularly described in U.S. Pat. No. 4,076,842, the entire content of which is incorporated herein by reference.

ZSM-35 is more particularly described in U.S. Pat. No. 4,016,245, the entire content of which is incorporated herein by reference.

ZSM-38 is more particularly described in U.S. Pat. No. 4,046,859, the entire content of which is incorporated herein by reference.

ZSM-5 and ZSM-11 are the preferred zeolites for purposes of this invention.

The specific zeolites described, when prepared in the presence of organic cations, are substantially catalytically inactive, possibly because the intracrystalline free space is occupied by organic cations from the forming solution. They may be activated by heating in an inert atmosphere at 1000° F. for one hour, for example, followed by base exchange with ammonium salts followed by calcination at 1000° F. in air. More generally, it is desirable to activate this type catalyst by base exchange with ammonium salts followed by calcination in air at about 1000° F. for from about 15 to about 24 hours.

For purposes of this invention, the zeolite selected preferably is one that has a crystal framework density, in the dry, hydrogen form, of not less than about 1.6 grams per cubic diameter. It has been found that zeolites which satisfy all three criteria, a Constraint Index as defined above of about 1 to about 12, a silica to alumina ratio of at least about 12 and a dried crystal density of not less than about 1.6 grams per cubic centimeter, are most effective. The dry density for known structures may be calculated from the number of silicon plus aluminum atoms per 1000 cubic Angstroms, as given, e.g., on Page 19 of the article of Zeolite Structure by W. M. Meier. This paper, the entire contents of which are incorporated herein by reference, is included in "Proceedings of the Conference on Molecular Sieves, London, April 1967," published by the Society of Chemical Industry, London, 1968. When the crystal structure is unknown, the crystal framework density may be determined by classical pyknometer techniques. For example, it may be determined by immersing the dry nitrogen form of the zeolite in an organic solvent which is not sorbed by the crystal. Or, the crystal density may be determined by mercury porposimetry, since mercury will fill the interstices between crystals but will not penetrate the intracrystalline free space. It is possible that the unusual sustained activity and stability of this class of zeolites is associated with its high crystal anionic framework of not less than about 1.6 grams per cubic centimeter. This high density must necessarily be associated with a relatively small amount of free space within the crystal, which might be expected to result in more stable structures. This free space, however, is important as the locus of catalytic activity.

Crystal framework densities of some typical zeolites including some which are not within the purview of this invention are:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| ZSM-12 | — | 1.8 |
| ZSM-23 | — | 2.0 |
| Dachiardite | .32 | 1.72 |
| L | .32 | 1.61 |
| Clinoptilolite | .34 | 1.71 |
| Laumontite | .34 | 1.77 |
| ZSM-4, Omega | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |

-continued

| Zeolite | Void Volume | Framework Density |
|---|---|---|
| Gmelinite | .44 | 1.46 |
| Chabazite | .47 | 1.45 |
| A | .5 | 1.3 |
| Y | .48 | 1.27 |

The platinum group metal be incorporated with the zeolite by any method known in the art, including base exchange and impregnation. The zeolite and platinum group metal may be incorporated in a matrix to form the final catalyst. Matrix materials include synthetic or naturally occurring substances as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee-Georgia and Florida clays.

In addition to the foregoing materials, the zeolites employed herein may be composited with a porous matrix material, such as alumina, silica-alumina, silica-magnesia, silica-zirconia, silica-thoria, silica-berylia, silica-titania as well as ternary compositions, such as silica-alumina-thoria, silica-alumina-zirconia, silica-alumina-magnesia and silica-magnesia-zirconia. The matrix may be in the form of a cogel. The relative proportions of zeolite component and inorganic oxide gel matrix on an anhydrous basis may vary widely with the zeolite content ranging from between about 10 to about 99 percent by weight and more usually in the range of about 25 to about 80 percent by weight of the dry composite. For purposes of the present invention, the preferred material is alumina.

The catalyst, to be effective in the present invention, must be steamed prior to use for conversion of a $C_9$+ feed. Why the steaming favorably affects the conservation of aromatic rings is not well understood.

In particular, steaming of the catalyst is conducted in such a manner as to reduce the alpha activity of the catalyst by at least 25 percent.

The acid activity of zeolite catalysts is conveniently defined by the alpha scale described in an article published in Journal of Catalysis, Vol. VI, pp 278–287 (1966). In this test, the zeolite catalyst is contacted with hexane under conditions prescribed in the publication and the amount of hexane which is cracked is measured. From this measurement is computed an "alpha" value which characterizes the catalyst for its cracking activity for hexane. The entire article above referred to is incorporated herein by reference. The alpha scale so described will be used herein to define activity levels for cracking n-hexane. And, in particular, for purposes of this invention, a catalyst with an alpha value between 20 and 150 after steaming is suitable.

U.S. Pat. No. 4,312,790 issued Jan. 26, 1982 to Butter and Chester describes in detail the techniques suitable for preparing a catalyst useful herein, including techniques for steaming the catalyst. The entire contents of that patent are incorporated herein by reference as if fully set forth.

For purposes of this invention, the $C_9$+ conversion may be conducted in a fixed bed, a fluidized bed, or in a transport bed. It is a feature of this invention that it may be practised very effectively in a lowcost fixed bed.

It will be recognized by those skilled in the art of aromatics processing that feed cuts are made by the least expensive distillation compatible with the required results. Thus, in the present instance, the $C_9$+ cut may contain a small percentage of xylenes, such as about 5 to 15%, for example. Typically, the contemplated feeds will have an average molecular weight of $C_{10}$ or $C_{11}$, with most of the alkyl groups (other than Methyl) consisting of ethyl and propyl groups. Typically, a cut will be free of material boiling above 500° F., and hence the process will be operating in the vapor phase.

Examples shall now be given to illustrate this invention. It is to be understood, of course, that the scope of this invention is not to be limited by the examples, said scope being defined by this entire specification including the appended claims. All parts are by weight unless explicitely stated to be otherwise.

EXAMPLES

The following abbreviations will be used in the examples which follow: B and Bz=benzene; T=tri- or toluene; X=xylene; M=methyl; E=ethyl; D=di-; and NC3T=normal propyltoluene. Thus, ET=ethyltoluene and TMB=trimethylbenzene. Ring loss and hydrogen consumed are computed values, and each is to be regarded in any one instance as an approximation.

EXAMPLES 1–5

In these examples the catalyst was in the form of a 1/16-inch extrudate and contained 0.1% Pt. The catalyst contained 50% ZSM-5 and 50% alumina. Prior to use, the catalyst was steamed in 100% steam at 0 psig and 900° F. for five hours. It had a fresh alpha value of 180 and, after steaming, an alpha value of 60. The feed composition, in wt%, was Bz=0.11, T=0.42, X=0.11, Cumene=0.11, ET=6.69, TMB=9.55, DEB=46.28, NC3T=0.55, EX=35.44, and C10BZ=0.74. The charge was passed over a fixed bed of catalyst under the conditions shown in Table 1, which also summarizes the results.

EXAMPLES 6–9

In these examples a catalyst similar to that used in examples 1–5 was used except that the catalyst after steaming had an alpha value of 50, and the extrudate was crushed before loading into the reactor. The charge used was of the same composition as that used in Examples 1–5.

Table 2 shows the reaction conditions for these experiments, and summarizes the results.

EXAMPLES 10–14

Examples 10–14 inclusive demonstrate the excellent long-term stability of the catalyst and its regenerability without significant loss either of activity or of selectivity.

The catalyst precursor used in these examples had the same composition as that of Example 1, except that it was steamed in 100% steam at 0 psig for four hours at 850° F. to produce a catalyst having an alpha value of 120. The catalyst was regenerated after 100 hours on stream (i.e. after Example 11) by burning in 1.7 Vol% air beginning at 725° F., raising the temperature to 850° F. over the first hour of the burn and maintaining that temperature overnight in flowing nitrogen-diluted air, after which the concentration of air was raised to 6.7

Vol% and the temperature was slowly (in about one hour) raised to 1000° F. The burn was then completed with four hours at 1000° F. in 100 Vol% air, after which the catalyst was reused in Examples 12, 13 and 14.

The feed used for Examples 10–14 had the following composition. T=0.43, X=0.11, ET=7.04, TMB=9.27, DEB=44.67, NC3T=0.32, EX=36.78, C10Bz=1.17 and C11Bz=0.21. The reaction conditions and results for these experiments are summarized in Table 3.

TABLE 1

| EXAMPLE NO. | 1 | 2 | 3 | 4 | 5 |
|---|---|---|---|---|---|
| TEMPERATURE, °F. | 836 | 758 | 747 | 753 | 803 |
| PRESSURE, PSIG | 200 | 200 | 200 | 200 | 200 |
| WHSV | 5.0 | 1.5 | 1.5 | 1.5 | 3.0 |
| H2/HC MOL RATIO | 4.8 | 5.0 | 5.5 | 5.5 | 5.1 |
| TIME ON STREAM, HRS | 22.0 | 25.5 | 116.5 | 120.0 | 124.5 |
| ET CONVERSION, WT % | 94.4 | 95.0 | 93.1 | 92.9 | 94.2 |
| TMB CONVERSION, WT % | 16.2 | 19.8 | 17.5 | 18.0 | 21.4 |
| DEB CONVERSION, WT % | 99.8 | 99.9 | 99.8 | 99.8 | 99.7 |
| EX CONVERSION, WT % | 74.4 | 87.9 | 84.0 | 83.7 | 78.8 |
| DEETHYLATION, MOL % | 78.3 | 92.4 | 86.4 | 87.6 | 98.7 |
| C2=/C2 Mol Ratio | 0.00 | 0.00 | 0.00 | 0.00 | 0.00 |
| C2-C5/ΔH2 MOL RATIO | 0.78 | 0.76 | 0.90 | 0.79 | 1.03 |
| T/ΔET MOL RATIO | 1.57 | 1.55 | 0.98 | 1.11 | 1.00 |
| B/ΔDEB MOL RATIO | 1.04 | 0.97 | 1.00 | 0.95 | 0.94 |
| EB/ΔDEB MOL RATIO | 0.06 | 0.05 | 0.09 | 0.09 | 0.07 |
| B+EB/ΔMOL RATIO | 1.11 | 1.02 | 1.09 | 1.04 | 1.01 |
| X/ΔEX MOL RATIO | 0.98 | 0.94 | 1.05 | 1.06 | 1.00 |
| H2 BALANCE | 95.2 | 96.1 | 96.9 | 97.0 | 101.0 |
| CARBON BALANCE | 100.3 | 100.9 | 99.5 | 101.3 | 100.8 |
| RING BALANCE | 104.7 | 99.6 | 101.3 | 102.0 | 97.5 |
| C2 BALANCE | 87.2 | 98.0 | 93.1 | 96.1 | 107.9 |
| TOTAL BALANCE | 99.4 | 100.0 | 98.9 | 100.5 | 100.7 |
| RING LOSS, MOL % | −5.2 | 0.6 | −2.2 | −1.3 | 3.4 |
| H2 CONSUM, MOL/MOL FEED | 1.3 | 1.3 | 1.3 | 1.7 | 1.4 |
| PROD DISTR, WT % | | | | | |
| C1 | 0.07 | 0.16 | 0.15 | 0.18 | 0.02 |
| C2 | 23.35 | 27.42 | 24.97 | 25.60 | 28.93 |
| C3 | 1.01 | 1.71 | 1.33 | 1.32 | 1.37 |
| C4 | 0.25 | 0.52 | 0.40 | 0.42 | 0.37 |
| C5+C6 | 0.18 | 0.31 | 0.42 | 0.35 | 0.14 |
| BZ | 27.55 | 25.38 | 25.85 | 25.03 | 24.74 |
| TOLUENE | 7.46 | 7.44 | 7.01 | 7.09 | 6.46 |
| EB | 2.27 | 1.96 | 2.98 | 3.31 | 2.52 |
| XYLENE | 20.32 | 22.84 | 23.16 | 22.80 | 20.45 |
| IC3BZ | 0.01 | 0.01 | 0.01 | 0.13 | 0.01 |
| ET | 0.37 | 0.32 | 0.47 | 0.47 | 0.38 |
| TMB | 7.69 | 7.31 | 7.50 | 7.50 | 7.21 |
| DEB | 0.11 | 0.05 | 0.09 | 0.10 | 0.13 |
| 1M2NC3BZ (NC3T) | 0.05 | 0.00 | 0.02 | 0.02 | 0.00 |
| EX | 8.99 | 4.21 | 5.29 | 5.30 | 6.91 |
| C10BZ | 0.19 | 0.18 | 0.18 | 0.24 | 0.18 |
| C11BZ | 0.16 | 0.16 | 0.16 | 0.18 | 0.16 |
| TOTAL | 100.00 | 100.00 | 100.00 | 100.00 | 100.00 |

TABLE 2

| EXAMPLE NO. | 6 | 7 | 8 | 9 |
|---|---|---|---|---|
| TEMPERATURE, °F. | 850 | 756 | 749 | 747 |
| PRESSURE, PSIG | 200 | 200 | 200 | 200 |
| WHSV | 5.1 | 1.5 | 1.5 | 1.5 |
| H2/HC MOL RATIO | 4.6 | 4.9 | 4.9 | 4.9 |
| TIME ON STREAM, HRS | 23.5 | 37.6 | 48.8 | 57.8 |
| ET CONVERSION, WT % | 96.7 | 94.4 | 92.3 | 92.0 |
| TMB CONVERSION, WT % | 26.0 | 24.7 | 22.1 | 22.2 |
| DEB CONVERSION, WT % | 99.9 | 99.9 | 99.9 | 99.8 |
| EX CONVERSION, WT % | 80.1 | 88.3 | 86.4 | 86.4 |
| DEETHYLATION, MOL % | 77.7 | 81.3 | 83.3 | 81.4 |
| C2=/C2 MOL RATIO | 0.00 | 0.00 | 0.00 | 0.00 |
| C2−C5/ΔH2 MOL RATIO | 0.65 | 0.77 | 0.79 | 0.78 |
| T/ΔET MOL RATIO | 1.35 | 1.27 | 1.24 | 1.28 |
| B/ΔDEB MOL RATIO | 1.11 | 1.03 | 0.97 | 0.97 |
| EB/ΔDEB MOL RATIO | 0.03 | 0.06 | 0.08 | 0.08 |
| B+EB/ΔDEB MOL RATIO | 1.14 | 1.09 | 1.05 | 1.05 |
| X/ΔEX MOL RATIO | 1.05 | 1.06 | 1.09 | 1.10 |

TABLE 2-continued

| EXAMPLE NO. | 6 | 7 | 8 | 9 |
|---|---|---|---|---|
| H2 BALANCE | 99.8 | 97.5 | 97.2 | 95.2 |
| CARBON BALANCE | 108.7 | 102.7 | 101.8 | 101.1 |
| RING BALANCE | 114.8 | 106.7 | 104.5 | 104.5 |
| C2 BALANCE | 90.2 | 88.5 | 90.9 | 88.4 |
| TOTAL BALANCE | 107.1 | 101.7 | 100.9 | 100.1 |
| RING LOSS, MOL % | −6.9 | −4.6 | −3.3 | −4.2 |
| H2 CONSUM, MOL/MOL FEED | 1.3 | 1.3 | 1.3 | 1.3 |
| PROD DISTR, WT % | | | | |
| C1 | 0.18 | 0.00 | 0.08 | 0.15 |
| C2 | 22.65 | 23.78 | 24.35 | 23.76 |
| C3 | 1.06 | 1.61 | 1.61 | 1.51 |
| C4 | 0.77 | 0.55 | 0.50 | 0.51 |
| C5+C6 | 0.67 | 0.52 | 0.19 | 0.22 |
| BZ | 29.13 | 27.11 | 25.61 | 25.52 |
| TOLUENE | 8.84 | 8.21 | 7.89 | 8.15 |
| EB | 1.13 | 2.29 | 2.85 | 3.00 |
| XYLENE | 21.75 | 24.25 | 24.28 | 24.49 |
| IC3BZ | 0.00 | 0.00 | 0.00 | 0.00 |
| ET | 0.21 | 0.37 | 0.50 | 0.52 |
| TMB | 6.75 | 6.89 | 7.13 | 7.12 |
| DEB | 0.03 | 0.04 | 0.06 | 0.07 |
| 1M2NC3BZ (NC3T) | 0.01 | 0.00 | 0.00 | 0.00 |
| EX | 6.46 | 3.80 | 4.44 | 4.44 |
| C10BZ | 0.19 | 0.24 | 0.25 | 0.28 |
| C11BZ | 0.19 | 0.35 | 0.25 | 0.26 |
| TOTAL | 100.00 | 100.00 | 100.00 | 100.00 |

TABLE 3

| EXAMPLE NO. | 10 | 11 | 12 | 13 | 14 |
|---|---|---|---|---|---|
| TEMPERATURE, °F. | 749 | 750 | 748 | 750 | 748 |
| PRESSURE, PSIG | 100 | 100 | 100 | 100 | 100 |
| WHSV | 1.7 | 1.5 | 1.5 | 1.5 | 1.5 |
| H2/HC MOL RATIO | 3.6 | 4.0 | 4.0 | 4.1 | 4.1 |
| TIME ON STREAM, HRS | 24.0 | 100.0 | 21.0 | 69.0 | 141.0 |
| ET CONVERSION, WT % | 96.9 | 96.0 | 98.4 | 98.1 | 97.6 |
| TMB CONVERSION, WT % | 9.4 | 6.4 | 5.2 | 8.3 | 11.7 |
| DEB CONVERSION, WT % | 99.8 | 99.9 | 100.0 | 99.7 | 99.8 |
| EX CONVERSION, WT % | 88.8 | 86.9 | 89.8 | 88.1 | 84.5 |
| DEETHYLATION, MOL % | 94.4 | 90.2 | 89.3 | 89.9 | 88.8 |
| C2=/C2 MOL RATIO | 0.00 | 0.00 | 0.00 | 0.00 | 0.00 |
| C2−C5/ΔH2 MOL RATIO | 0.96 | 1.02 | 0.97 | 0.91 | 0.91 |
| T/ΔET MOL RATIO | 1.70 | 1.74 | 1.61 | 1.54 | 1.49 |
| B/ΔDEB MOL RATIO | 0.94 | 0.94 | 0.94 | 0.95 | 0.95 |
| EB/ΔDEB MOL RATIO | 0.04 | 0.05 | 0.02 | 0.02 | 0.02 |
| B+EB/ΔDEB MOL RATIO | 0.98 | 0.99 | 0.96 | 0.97 | 0.98 |
| X/ΔEX MOL RATIO | 0.97 | 0.99 | 0.99 | 1.00 | 1.00 |
| H2 BALANCE | 97.9 | 97.9 | 95.6 | 96.9 | 96.6 |
| CARBON BALANCE | 99.2 | 98.7 | 97.0 | 99.2 | 98.8 |
| RING BALANCE | 99.0 | 100.1 | 97.7 | 99.9 | 99.8 |
| C2 BALANCE | 98.0 | 94.4 | 89.8 | 93.1 | 92.8 |
| TOTAL BALANCE | 99.0 | 98.5 | 96.7 | 98.8 | 98.4 |
| RING LOSS, MOL % | 0.1 | −1.5 | −1.0 | −1.0 | −1.3 |
| H2 CONSUM, MOL/MOL FEED | 1.3 | 1.3 | 1.3 | 1.3 | 1.3 |
| PROD DISTR, WT % | | | | | |
| C1 | 0.01 | 0.00 | 0.02 | 0.01 | 0.01 |
| C2 | 27.46 | 26.30 | 26.19 | 26.33 | 26.02 |
| C3 | 0.97 | 0.75 | 1.32 | 1.27 | 0.98 |
| C4 | 0.23 | 0.13 | 0.40 | 0.35 | 0.25 |
| C5+C6 | 0.04 | 0.01 | 0.20 | 0.11 | 0.08 |
| BZ | 28.59 | 23.64 | 23.91 | 24.09 | 24.12 |
| TOLUENE | 8.67 | 8.86 | 9.19 | 8.77 | 8.46 |
| EB | 1.20 | 1.58 | 0.57 | 0.72 | 0.90 |
| XYLENE | 24.88 | 24.92 | 25.54 | 25.14 | 24.10 |
| ET | 0.21 | 0.27 | 0.11 | 0.13 | 0.16 |
| TMB | 8.19 | 8.48 | 8.62 | 8.33 | 8.02 |
| DEB | 0.09 | 0.04 | 0.00 | 0.12 | 0.09 |
| 1M2NC3BZ (NC3T) | 0.03 | 0.01 | 0.00 | 0.03 | 0.00 |
| EX | 4.08 | 4.81 | 3.65 | 4.26 | 5.56 |
| C10BZ | 0.18 | 0.13 | 0.14 | 0.16 | 0.92 |
| C11BZ | 0.18 | 0.07 | 0.18 | 0.18 | 0.33 |
| TOTAL | 100.00 | 100.00 | 100.00 | 100.00 | 100.00 |

Process for Manufacturing para Xylene

The process of converting a $C_9$+ feed to BTX is particularly well suited for combination with a catalytic xylene isomerization step for the manufacture of para xylene. And, while it may be combined with any catalytic isomerization process, it is especially advantageous when the isomerization catalyst is of the ZSM-5 variety. In such combination the separate catalytic steps are adjusted to provide optimal conversion with reduced loss of aromatic rings. An embodiment of the process for manufacturing para xylene will be described by reference to the annexed drawing.

A fresh feed comprising a mixture of $C_8$ aromatics is introduced to the system by line 10 to mix with xylene recycle from line 11 and the mixture is passed to p-xylene recovery unit 12 from which p-xylene at high purity is withdrawn as the major product by line 13. Xylene recovery unit 12 will be of any type suited to the purpose, for example the fractional crystallization equipment described in Machell et al U.S. Pat. No. 3,662,013.

The effluent from recovery unit 12 is constituted by $C_8$ aromatics lean in p-xylene and containing the ethyl benzene, o-xylene and m-xylene present in the feed to the recovery unit 12. That effluent passes by line 14 to isomerizer 15 in admixture with hydrogen supplied by line 16. Isomerizer 15 is operated in accordance with the disclosure of the Morrison U.S. Pat. No. 3,856,872, but at relatively mild conditions of 550°–700° F. These relatively low temperatures conserve xylene content while isomerizing the xylenes to near equilibrium ratios, but with less conversion of ethyl benzene that can be achieved at more severe reaction conditions. As will be seen from data presently to be described, the gaseous paraffin content of the isomerizer effluent at these conditions is essentially propane which remains with the liquid phase in a flash drum or high pressure separator 17 to which the isomerizer effluent passes by line 18 after admixture with products of heavy aromatics processing from line 19 and cooling in heat exchanger 20. Flash drum 17 operates at about 100° F. at pressure resulting from conditions of reaction in isomerization and heavy aromatics processing whereby hydrogen and a small amount of light hydrocarbons are separated as gas to be recycled via line 21. At the conditions of operation, much of the light paraffin content of feed to flash drum 17 remains dissolved in the liquid portion withdrawn by line 22. Makeup hydrogen to replace that consumed in the system may be added conveniently to the vapor space of flash drum 17 from line 23.

The liquid fraction from flash drum 17 passes by line 22 to a fractionation column 23 where it is split to take $C_8$+ hydrocarbons as bottoms and lighter material overhead by line 24 to a condenser 25 from which light ends are removed by line 26 for appropriate disposal, preferably as fuel gas. The liquid fraction from condenser 25 is transferred by line 27 to toluene tower 28 from which high purity toluene is withdrawn as bottoms by line 29. Overhead from tower 28 is fed by line 30 to benzene tower 31 from which benzene is withdrawn at high purity by line 32 while overhead of light gases in line 33 is suitable for use as fuel gas. Alternatively, the liquid in line 27 may be transferred to an existing distillation train for recovery of benzene and toluene from extracted BTX.

Bottoms from splitter 23 is transferred by line 34 to xylene splitter 35 from which overhead is composed of the $C_8$ aromatics from isomerization and heavy aromatics processing and is recycled to p-xylene recovery unit 12 by line 11 as previously described.

A minor portion of heavy aromatics, say dicyclics, is discharged from the system as bottoms of splitter 35 by line 36. A $C_9+$ fractions is taken from xylene splitter 35 as a side stream at line 37 for recycle to heavy aromatics processing in reactor 38 after mixing with recycle hydrogen from line 39. Conditions in reactor 38 are essentially those described in Brennan and Morrison U.S. Pat. No. 3,945,913, but at the upper portion of the temperature range there stated, namely 750° to 900° F. and hydrogen recycle rate of 2 to 10 mols of hydrogen per mol of hydrocarbon charge. The catalyst for this reaction may be any solid porous acidic catalyst, but is preferably an aluminosilicate zeolite having a silica/alumina ratio greater than 12 and a Constraint Index of 1 to 12 as described in U.S. Pat. No. 3,968,024 (Gorring and Shipman) granted July 6, 1976, the disclosure of which is incorporated herein by this reference.

In a preferred form of the invention, toluene from tower 28 is added to the feed for heavy aromatics reactor 38 by recycle line 40. Alternatively, toluene may be withdrawn as a product at line 41.

The catalyst in isomerization reactor 15 is of the same nature as that preferred for reactor 38, to wit an alumino-silicate zeolite having a silica/alumina ratio of at least 12 and a Constraint Index between 1 and 12.

Reaction Conditions

Regardless whether the embodiment of this invention used is that in which one converts a $C_9+$ feed to BTX, or that in which this conversion cooperates with a xylene isomerization reactor to produce para xylene, the ranges of reaction conditions are the same and include a temperature of 600° to 900° F., with the preferred range being 650° to 800° F., a pressure of about 50 to 750 psig, a WHSV of about 0.5 to 30, and a hydrogen to hydrocarbon mol ratio of about 0.5 to 10. It has been found that within these ranges the catalytic activity and selectivity is stable for very protracted periods of time. In some instances for example, satisfactory performance may be obtained over a period of months. In any case, when the catalyst activity or selectivity has reached an unsatisfactory state, the catalyst may be regenerated by burning in air as illustrated in the foregoing examples.

It is a feature of this process that it may be operated with combinations of reaction conditions such that little or substantially no loss of aromatic rings occurs. For example, a combination of conditions, each within its prescribed range, may be chosen such that extensive conversion of the feed is achieved with less than about one percent loss of aromatic rings. When the embodiment of this process is used in which the objective is to produce BTX, it is contemplated to select reaction conditions in such combinations as to produce the desired level of conversion of the feed without loss of more than one percent of the aromatic rings in the feed. When the embodiment of this invention is used in which the catalyst of this invention cooperates with a xylene isomerization catalyst to produce para xylene, it is contemplated to adjust both reactors to cooperatively optimize the para xylene production process. In some instances, this optimization may result in conditions which produce slightly more than about one percent aromatic ring loss. This loss may be brought within the 1% limitation by conducting the isomerization with a crystalline zeolite catalyst having a Constraint Index of 1 to 12.

What is claimed is:

1. A process for converting to BTX a $C_9+$ monocyclic aromatic hydrogen distillate which boils below about 500° F., said distillate having an average content per benzene ring of about 0.5 to 3.0 alkyl groups of more than one carbon atom, which process comprises:

contacting said distillate and hydrogen with a steamed zeolite catalyst at a temperature of 650° F. to 800° F., a pressure of about 50 to 750 psig, a WHSV of about 0.5 to 30 and a hydrogen to hydrocarbon mol ratio of about 0.5 to 10, said catalyst comprising a crystalline zeolite having a Constraint Index of 1 to 12, a silica to alumina ratio of at least 12, and a platinum group metal incorporated in cationic from with said zeolite prior to final catalyst particle formation and prior to any calcination or steaming of said zeolite, said steamed catalyst having been steamed under conditions effective to reduce its alpha value by at least 25 percent.

2. The process described in claim 1 wherein the alpha value of said catalyst after steaming is between about 20 and 150.

3. The process described in claim 1 wherein said crystalline aluminosilicate zeolite is ZSM-5 or ZSM-11.

4. The process described in claim 2 wherein said crystalline aluminosilicate zeolite is ZSM-5 or ZSM-11.

5. The process described in claim 1 or claim 2 or claim 3 or claim 4 wherein said platinum group metal is platinum and the platinum content of said catalyst is about 0.001 to 1.0% by weight of said zeolite in said catalyst.

6. A process for converting a $C_9+$ monocyclic aromatic hydrocarbon distillate by-product from a catalytic xylene isomerization process into liquid product rich in benzene, toluene and xylenes and gaseous product rich in alkanes having more than one carbon atom which process comprises contacting said by-product and hydrogen with a zeolite catalyst at a temperature of 650° F. to 800° F., a pressure of about 50 to 750 psig, a WHSV of about 0.5 to 30 and a hydrogen to hydrocarbon mol ratio of about 0.5 to 10, said catalyst comprising a crystalline zeolite having a Constraint Index of 1 to 12, a silica to alumina ratio of at least 12, and a platinum group metal incorporated in cationic form with said zeolite prior to final catalyst particle formation and prior to any calcination or steaming of said zeolite, said catalyst having been steamed under conditions effective to reduce its alpha value by at least 25 percent.

7. The process described in claim 6 wherein the alpha value of said catalyst after steaming is between about 20 and 150.

8. The process described in claim 6 or 7 wherein said platinum group metal is platinum, and said zeolite is ZSM-5.

9. The process described in claim 6 or 7 wherein said platinum group metal is platinum and it is present in from about 0.001 to about 1.0% by weight.

10. In a process for manufacturing para xylene from a liquid hydrocarbon feed consisting essentially of $C_8$ monocyclic aromatic hydrocarbons including para xylene, which process comprises crystallizing and recovering the para xylene isomer from said feed and catalytically isomerizing the para isomer depleted remainder with a first catalyst comprising a crystalline aluminosilicate zeolite having a Constraint Index of 1 to 12 and a silica to alumina ratio of at least 12 thereby replenishing the depleted isomer with concomitant formation of $C_9+$ alkylaromatic by-product; the improvement, which comprises separating said alkylaromatic by-product and contacting it in the presence of hydrogen with a second catalyst comprising a crystalline zeolite having a Constraint Index of 1 to 12, a silica to alumina ratio of at least 12, and a platinum group metal incorporated in cationic form with said zeolite prior to final catalyst particle formation and prior to any calcination or steaming of said zeolite, said second catalyst having been steamed under conditions effective to reduce its alpha value into the range of 20 to 150.

11. The improvement described in claim 10 wherein said crystalline aluminosilicate zeolite in said first catalyst is ZSM-5 or ZSM-11, and said crystalline aluminosilicate zeolite in said second catalyst is ZSM-5 or ZSM-11.

* * * * *

UNITED STATES PATENT AND TRADEMARK OFFICE

CERTIFICATE OF CORRECTION

PATENT NO. : 4, 469,909

DATED : September 4, 1984

INVENTOR(S) : Arthur W. CHESTER & Yung-Feng CHU

It is certified that error appears in the above—identified patent and that said Letters Patent is hereby corrected as shown below:

Column 2, line 30, "thermodynanic" should be --thermodynamic--.

Column 4, line 61, "posses" should be --possess--.

Column 6, line 39, "porposimetry" should be --porosimetry--.

Column 7, line 10, "metal be" should be --metal may be--.

Column 13, line 15, "fractions" should be --fraction--.

Signed and Sealed this

*Nineteenth* Day of *February 1985*

[SEAL]

*Attest:*

DONALD J. QUIGG

*Attesting Officer*

*Acting Commissioner of Patents and Trademarks*